US011958707B2

(12) United States Patent
Hamakubo et al.

(10) Patent No.: US 11,958,707 B2
(45) Date of Patent: Apr. 16, 2024

(54) SHEET TRANSPORT ROLLER RUBBER COMPOSITION AND SHEET TRANSPORT ROLLER

(71) Applicant: SUMITOMO RUBBER INDUSTRIES, LTD., Hyogo (JP)

(72) Inventors: Masashi Hamakubo, Hyogo (JP); Ryosuke Fujii, Hyogo (JP); Satoshi Ito, Hyogo (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 17/866,556

(22) Filed: Jul. 18, 2022

(65) Prior Publication Data

US 2023/0192432 A1 Jun. 22, 2023

(30) Foreign Application Priority Data

Dec. 22, 2021 (JP) ..... 2021-208611

(51) Int. Cl.
*B65H 27/00* (2006.01)

(52) U.S. Cl.
CPC ..... *B65H 27/00* (2013.01); *B65H 2404/19* (2013.01)

(58) Field of Classification Search
CPC ..... B65H 27/00; B65H 2404/19
See application file for complete search history.

(56) References Cited

U.S. PATENT DOCUMENTS

| | | | | |
|---|---|---|---|---|
| 6,127,031 | A * | 10/2000 | Fukumoto | B65H 27/00 428/323 |
| 6,919,401 | B2 * | 7/2005 | Mabuchi | B65H 27/00 525/326.1 |
| 8,900,108 | B2 * | 12/2014 | Mine | C08L 23/16 492/53 |
| 9,109,065 | B2 * | 8/2015 | Ebata | C08F 210/18 |
| 9,828,526 | B2 * | 11/2017 | Evdokimov | C09F 1/04 |
| 10,131,726 | B2 * | 11/2018 | Ichino | C08L 9/06 |
| 10,975,223 | B2 * | 4/2021 | Ichino | C09K 3/10 |
| 11,078,352 | B2 * | 8/2021 | Ichino | C08J 3/24 |
| 2005/0119097 | A1 * | 6/2005 | Nishimori | B65H 27/00 29/895.32 |
| 2007/0088128 | A1 * | 4/2007 | Minagoshi | C08L 23/16 525/192 |
| 2011/0130259 | A1 * | 6/2011 | Ito | B65H 27/00 492/59 |
| 2014/0042691 | A1 * | 2/2014 | Mine | B65H 5/06 271/264 |
| 2016/0009903 | A1 * | 1/2016 | Morita | C08F 4/44 525/332.9 |

FOREIGN PATENT DOCUMENTS

| | | |
|---|---|---|
| JP | H07268313 | 10/1995 |
| JP | 2020002271 | 1/2020 |

* cited by examiner

*Primary Examiner* — Jason L Vaughan
(74) *Attorney, Agent, or Firm* — JCIPRNET

(57) ABSTRACT

A sheet transport roller having a high friction coefficient and a rubber composition for forming a roller main body thereof. The rubber composition of the present disclosure, which is a rubber composition for forming the roller main body of the sheet transport roller, contains a rubber component containing an ethylene-α-olefin copolymer and a rosin component.

10 Claims, 2 Drawing Sheets

SHEET TRANSPORT ROLLER RUBBER COMPOSITION AND SHEET TRANSPORT ROLLER

CROSS-REFERENCE TO RELATED APPLICATION

This application claims the priority benefit of Japan application serial no. 2021-208611, filed on Dec. 22, 2021. The entirety of the above-mentioned patent application is hereby incorporated by reference herein and made a part of this specification.

BACKGROUND

Technical Field

The present disclosure relates to a sheet transport roller rubber composition and a sheet transport roller formed by using the same.

Description of Related Art

In the related art, as a roller of OA equipment such as a printer, an ethylene propylene diene rubber (EPDM) roller is often used from the aspect of the friction coefficient, environmental durability (ozone resistance or the like), and cost. There are various types of paper used in a printer or the like, and a high friction coefficient is required for rollers in some cases. Therefore, research such as increasing the friction coefficient by adding EPDM to oil or the like to lower the hardness or increasing the friction coefficient by incorporating isoprene rubber (IR) has been conducted.

For example, Patent Document 1 discloses a rubber composition for forming a roller main body of a roller, containing rubber including at least ethylene propylene diene rubber, a filler at 20 parts by mass or less with respect to 100 parts by mass of the total amount of the rubber, and a peroxide crosslinking agent at 2.5 parts by mass or more with respect to 100 parts by mass of the total amount of the rubber, in which the ethylene propylene diene rubber is a non-oil-extended ethylene propylene diene rubber having an ethylene content of 55% or more and 72% or less and an oil-extended ethylene propylene diene rubber, and the proportion of the non-oil-extended ethylene propylene diene rubber is 20 parts by mass or more and 80 parts by mass or less with respect to 100 parts by mass of the total amount of the rubber.

Patent Document 2 discloses an elastomer roller treatment agent containing an organic solvent solution of a rosin substance (claim 1 of reference Patent Document 2).

PATENT DOCUMENTS

[Patent Document 1] Japanese Patent Laid-Open No. 2020-002271

[Patent Document 2] Japanese Patent Laid-Open No. H7-268313

SUMMARY

The present disclosure has been made in view of the above circumstances, and provides a sheet transport roller having a high friction coefficient and a rubber composition for forming the roller. Furthermore, the present disclosure provides a method for producing a sheet transport roller rubber composition.

The sheet transport roller rubber composition of the present disclosure, which can solve the above problems, contains a rubber component containing an ethylene-α-olefin copolymer and a rosin and/or a rosin derivative.

The present disclosure includes a sheet transport roller obtained by curing the sheet transport roller rubber composition of the present disclosure.

In the present disclosure, a method for producing a sheet transport roller rubber composition, including a first step of obtaining a kneaded product obtained by kneading a rubber composition containing an ethylene-α-olefin copolymer and a rosin and/or a rosin derivative at a temperature equal to or higher than a softening point of the rosin and/or the rosin derivative is included.

According to the present disclosure, a sheet transport roller having a high friction coefficient can be obtained.

DESCRIPTION OF THE EMBODIMENTS

Figure 1:
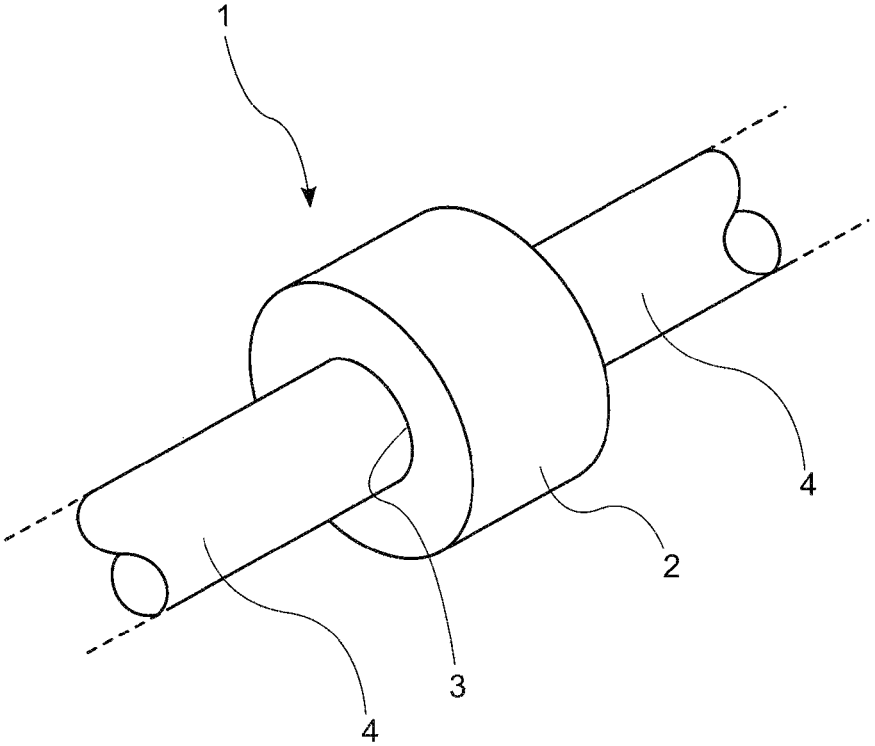
FIG. 1 is a perspective view showing an example of an embodiment of a sheet transport roller of the present disclosure.

There is provided a sheet transport roller rubber composition according to the present disclosure containing a rubber component containing an ethylene-α-olefin copolymer and a rosin and/or a rosin derivative.

[Rubber Component]

The sheet transport roller rubber composition according to the present disclosure preferably contains the rubber component containing the ethylene-α-olefin copolymer. First, the rubber component will be described.

(Ethylene-α-Olefin Copolymer)

The ethylene-α-olefin copolymer is not particularly limited as long as the ethylene-α-olefin copolymer is a copolymer having a constituting unit derived from ethylene and a constituting unit derived from an α-olefin (hereinafter, may be referred to as "ethylene unit" and "α-olefin unit", respectively).

As the α-olefin, α-olefins having 3 to 20 carbon atoms are preferable. Specific examples of the α-olefin include linear olefins such as propylene, 1-butene, 1-pentene, 1-hexene, 1-heptene, 1-octene, 1-nonene, and 1-decene; branched chain olefins such as 3-methyl-1-butene, 3-methyl-1-pentene, and 4-methyl-1-pentene; and cyclic olefins such as vinylcyclohexane. These may be used alone or in combination. Of these, α-olefins having 3 to 8 carbon atoms are preferable, α-olefins having 3 to 6 carbon atoms are more preferable, α-olefins having 3 to 4 carbon atoms are further preferable, and propylene is particularly preferable.

The ethylene-α-olefin copolymer may have only a constituting unit derived from ethylene and a constituting unit derived from an α-olefin, but may further have a constituting unit derived from other monomers (hereinafter, simply may be referred to as "other monomer units").

As the other monomers, a diene is preferable, a non-conjugated diene is more preferable, and non-conjugated dienes having 5 to 20 carbon atoms are further preferable. Specific examples of the non-conjugated diene include chain non-conjugated dienes such as 1,4-hexadiene, 1,6-octadiene, 2-methyl-1,5-hexadiene, 6-methyl-1,5-heptadiene, and 7-methyl-1,6-octadiene; and cyclic non-conjugated dienes such as cyclohexadiene, dicyclopentadiene, 5-vinyl norbornene, 5-ethylidene-2-norbornene, 5-(2-propenyl)-2-norbornene, 5-(4-pentenyl)-2-norbornene, 5-(5-hexenyl)-2-norbornene, 5-(7-octenyl)-2-norbornene, 5-methylene-2-norbornene, and 6-chloromethyl-5-isopropenyl-2-norbornene. These may be used alone or in combination. Of these, 5-ethylidene-2-norbornene, dicyclopentadiene, and 1,4-hexadiene are preferable, and 5-ethylidene-2-norbornene is more preferable.

In the present disclosure, an ethylene-α-olefin copolymer containing a diene component may be referred to as an ethylene-α-olefin-diene copolymer. In the present disclosure, the ethylene-α-olefin-diene copolymer is a subordinate concept of the ethylene-α-olefin copolymer.

In the ethylene-α-olefin copolymer, the content of ethylene units is preferably 40% by mass or more, more preferably 42% by mass or more, and further preferably 43% by mass or more, and preferably 79% by mass or less, more preferably 78% by mass or less, and further preferably 77% by mass or less. This is because, when the content of ethylene units is within the above range, the ethylene-α-olefin copolymer is easily obtained as a commercially available product, can be molded as a sheet transport roller, and becomes a rubber suitable for a sheet transport roller.

In the ethylene-α-olefin-diene copolymer, the content of ethylene units is preferably 40% by mass or more, more preferably 42% by mass or more, and further preferably 43% by mass or more, and preferably 79% by mass or less, more preferably 78% by mass or less, and further preferably 77% by mass or less. This is because, when the content of ethylene units is within the above range, the ethylene-α-olefin-diene copolymer is easily obtained as a commercially available product, can be molded as a sheet transport roller, and becomes a rubber suitable for a sheet transport roller.

In the ethylene-α-olefin-diene copolymer, the content of diene units is preferably 0.5% by mass or more, more preferably 0.7% by mass or more, and further preferably 1.0% by mass or more, and preferably 15% by mass or less, more preferably 14% by mass or less, and further preferably 13% by mass or less. This is because, when the content of diene units is within the above range, the ethylene-α-olefin-diene copolymer is easily obtained as a commercially available product, can be molded as a sheet transport roller, and becomes a rubber suitable for a sheet transport roller.

In addition, the content of ethylene units, the content of α-olefin units, and the content of other monomer units in the copolymer can be determined by, for example, 13C-NMR.

The ethylene-α-olefin copolymer includes an oil-extended type in which extender oil is added to impart flexibility and a non-oil-extended type in which no extender oil is added, but in the present disclosure, any of these may be used. In the present disclosure, when the non-oil-extended type and the oil-extended type are used in combination, the content of the non-oil-extended type is preferably 15% by mass or more, more preferably 20% by mass or more, and further preferably 25% by mass or more with respect to the total mass of the solid content (ethylene-α-olefin copolymer itself excluding the extender oil) contained in the non-oil-extended type and the oil-extended type from the viewpoint of wear resistance.

The ethylene-α-olefin copolymer can be produced, for example, by a known method of copolymerizing a monomer mixture containing ethylene, α-olefin and, if necessary, other monomers in the presence of a catalyst. Further, a commercially available product may be used.

In the present disclosure, examples of the ethylene-α-olefin copolymer include an ethylene-propylene copolymer (EPM), an ethylene-propylene-diene copolymer (EPDM), an ethylene-butene copolymer (EBR), an ethylene-octene copolymer (EOR), an ethylene-propylene-butene copolymer (EPBR), an ethylene-butene-diene copolymer (EBDM), and an ethylene-propylene-butene-diene copolymer. In the present disclosure, it is preferable to use an ethylene-propylene-diene copolymer (EPDM) as the ethylene-α-olefin copolymer. The EPDM may be used alone or in combination of two or more.

Examples of the commercially available EPDM products include Esprene (registered trademark) 301 [ethylene content: 62%, diene content: 3.0%], 301A [ethylene content: 50%, diene content: 5.0%], 501A [ethylene content: 52%, diene content: 4.0%], 505A [ethylene content: 50%, diene content: 9.5%], 505 [ethylene content: 50%, diene content: 10.0%], 502 [ethylene content: 56%, diene content: 4.0%], 512F [ethylene content: 65%, diene content: 4.0%], 532 [ethylene content: 51%, diene content: 3.5%], 552 [ethylene content: 55%, diene content: 4.0%], 553 [ethylene content: 58%, diene content: 4.5%], 5206F [ethylene content: 54%, diene content: 8.5%], 5527F [ethylene content: 54%, diene content: 8.5%], and 586 [ethylene content: 66%, diene content: 12.5%] (the above are non-oil-extended types); and 7456 [ethylene content: 53%, diene content: 10.5%, oil extension amount: 20 phr], 603 [ethylene content: 64%, diene content: 4.5%, oil extension amount: 40 phr], 6101 [ethylene content: 70%, diene content: 6.5%, oil extension amount: 70 phr], 601F [ethylene content: 59%, diene content: 3.5%, oil extension amount: 70 phr], 600F [ethylene content: 66%, diene content: 4.0%, oil extension amount: 100 phr], and 670F [ethylene content: 66%, diene content: 4.0%, and oil extension amount: 100 phr] (the above are oil-extended types), which are manufactured by Sumitomo Chemical Co., Ltd. ("%" is "% by mass").

Examples thereof also include NORDEL (Nordel, registered trademark) 3640 [ethylene content: 55%, diene content: 1.8%], 3720P [ethylene content: 70%, diene content: 0.6%], 3722P [ethylene content: 71%, diene content: 0.5%], 3745P [ethylene content: 70%, diene content: 0.5%], 3760P [ethylene content: 67%, diene content: 2.2%], 4520 [ethylene content: 50%, diene content: 4.9%], 4570 [ethylene content: 50%, diene content: 4.9%], 4572 XFM [ethylene content: 50%, diene content: 4.9%], 4640 [ethylene content: 55%, diene content: 4.9%], 4725P [ethylene content: 70%, diene content: 4.9%], 4760P [ethylene content: 67%, diene content: 4.9%], 4770P [ethylene content: 70%, diene content: 4.9%], 4785HM [ethylene content: 68%, diene content: 4.9%], 4820P [ethylene content: 85%, diene content: 4.9%], 5565 [ethylene content: 50%, diene content: 7.5%], 6530 XFC [ethylene content: 55%, diene content: 8.5%], 6565 XFC [ethylene content: 55%, diene content: 8.5%], 3722P EL [ethylene content: 71%, diene content: 0.5%], 3745P EL [ethylene content: 70%, diene content: 0.5%], 4770P EL [ethylene content: 70%, diene content: 4.9%], and 4770R EL [ethylene content: 70%, diene content: 4.9%] (the above are non-oil-extended types); and 6555 OE [ethylene content: 53%, diene content: 8.5%, oil extension amount: 23 phr] (oil-extended types), which are manufactured by Dow Chemical Company Ltd. ("%" is "mass %").

Examples thereof also include EP331 [ethylene content: 47%, diene content: 11.3%], EP342 [ethylene content: 47%, diene content: 9%], EP251 [ethylene content: 53.5%, diene content: 9%], EP65 [ethylene content: 53.5%, diene content: 9%], EP35 [ethylene content: 52%, diene content: 8.1%], EP33 [ethylene content: 52%, diene content: 8.1%], T7421 [ethylene content: 52%, diene content: 7.7%], EP21 [ethylene content: 61%, diene content: 5.8%], EP51 [ethylene content: 67%, diene content: 5.8%], EP25 [ethylene content: 58.5%, diene content: 5.1%], EP22 [ethylene content: 54%, diene content: 4.5%], EP24 [ethylene content: 54%, diene content: 4.5%], EP123 [ethylene content: 58%, diene content: 4.5%], EP103AF [ethylene content: 59%, diene content: 4.5%], EP107F [ethylene content: 62%, diene content: 4.5%], EP57F/C [ethylene content: 67%, diene content: 4.5%], EP27 [ethylene content: 54.5%, diene content: 4%], and EP93 [ethylene content: 55%, diene content: 2.7%] (the above are non-oil-extended types); and EP96 [ethylene content: 66%, diene content: 5.8%, oil extension amount: 50 phr], EP501EC [ethylene content: 65.5%, diene content: 5.5%, oil extension amount: 40 phr], EP98 [ethylene content: 66%, diene content: 4.5%, oil extension amount: 75 phr], and EP104E [ethylene content: 52%, diene content: 3.5%, oil extension amount: 30 phr] (the above are oil-extended types), which are manufactured by JSR Corporation ("%" is "mass %").

Examples thereof also include Mitsui EPT (registered trademark) 1045 [ethylene content: 58%, diene content: 5.0%], 1070 [ethylene content: 57%, diene content: 4.0%], 2060M [ethylene content: 55%, diene content: 2.3%], 3045 [ethylene content: 56%, diene content: 4.7%], 3070 [ethylene content: 58%, diene content: 4.7%], 3091 [ethylene content: 61%, diene content: 5.4%], 3092M [ethylene content: 65%, diene content: 4.6%], 3110M [ethylene content: 56%, diene content: 5.0%], X-4010M [ethylene content: 54%, diene content: 7.6%], 4021 [ethylene content: 51%, diene content: 8.1%], 4045 [ethylene content: 54%, diene content: 8.1%], 4045M [ethylene content: 45%, diene content: 7.6%], 4070 [ethylene content: 56%, diene content: 8.1%], 8030M [ethylene content: 47%, diene content: 9.5%], 9090M [ethylene content: 41%, diene content: 14.0%], X-3012P [ethylene content: 72%, diene content: 3.6%], 3092PM [ethylene content: 65%, diene content: 4.6%], and K-9720 [ethylene content: 77%, diene content: 10.4%] (the above are non-oil-extended types); and X-3042E [ethylene content: 66%, diene content: 4.7%, oil extension amount: 120 phr], 3062EM [ethylene content: 65%, diene content: 4.5%, oil extension amount: 20 phr], 3072EM [ethylene content: 64%, diene content: 5.4%, oil extension amount: 40 phr], 3090EM [ethylene content: 48%, diene content: 5.2%, oil extension amount: 10 phr], 8120E [ethylene content: 56%, diene content: 9.5%, oil extension amount: 20 phr], 3072EPM [ethylene content: 64%, diene content: 5.4%, oil extension amount: 40 phr], and PX-049PEM [ethylene content: 56%, diene content: 5.0%, oil extension amount: 10 phr] (the above are oil-extended types), which are manufactured by Mitsui Chemicals, Inc. ("%" is "mass %").

The rubber component contained in the sheet transport roller rubber composition of the present disclosure preferably contains the ethylene-α-olefin copolymer as a main component. The content of the ethylene-α-olefin copolymer in the rubber component is preferably 50% by mass or more, more preferably 80% by mass or more, and further preferably 90% by mass or more. In the present disclosure, it is also preferable that the rubber component contain only an ethylene-α-olefin copolymer.

(Other Rubber Components)

The rubber component contained in the sheet transport roller rubber composition of the present disclosure may contain other rubber components in addition to the ethylene-α-olefin copolymer.

As the other rubber component, a diene-based rubber is preferable from the viewpoint of cost reduction and improvement of roller performance. Specific examples of the diene-based rubber include natural rubber (NR); and synthetic rubber such as isoprene rubber (IR), styrene butadiene rubber (SBR), acrylonitrile butadiene rubber (NBR), butadiene rubber (BR), and chloroprene rubber (CR). These may be used alone or in combination. Among these, SBR is preferable from the viewpoint of cost reduction. Further, IR or NR is preferable from the viewpoint of improving the friction coefficient. As the diene-based rubber, either non-oil-extended rubber or oil-extended rubber may be used.

As the synthetic rubber, a commercially available product may be used. Although not particularly limited, examples of SBR include Nipol 1502, 1723, 1739, and 9548 manufactured by Zeon Corporation. Examples of IR include Nipol (registered trademark) IR2200 and IR2200L manufactured by Zeon Corporation.

Among the rubber components contained in the sheet transport roller rubber composition of the present disclosure, the content of the other rubber components is preferably 5% by mass or more, more preferably 10% by mass or more, and further preferably 15% by mass or more, and preferably 45% by mass or less, more preferably 40% by mass or less, and further preferably 30% by mass or less. By setting the content of the other rubber components within the above range, it is possible to reduce the cost of the obtained roller while maintaining a high friction coefficient.

In the present disclosure, when the oil-extended type is used as the ethylene-α-olefin copolymer or other rubber components, the content is calculated based on the amount of the solid content (rubber component itself excluding the extender oil) contained in the oil-extended type.

[Rosin and/or Derivative Thereof]

The sheet transport roller rubber composition of the present disclosure contains a rosin and/or a rosin derivative (hereinafter, may be simply referred to as a "rosin component"). The rosin and the rosin derivative may be used alone or in combination of both.

Rosin is a residue that remains after collecting balsams such as turpentine, which is the sap of Pinaceae plants, and distilling terepine essential oil, and is a natural resin containing rosin acid (abietic acid, palustric acid, isopimalic acid, and the like) as a main component. Examples of the rosin include raw material rosins such as gum rosin, wood rosin, and tall oil rosin, and refined products thereof. These rosins may be used alone or two or more thereof may be mixed and used.

The rosin derivative is not particularly limited as long as the rosin derivative is a derivative of rosin, and examples thereof include rosins treated with hydrogenation, disproportionation, polymerization, esterification, modification (for example, acid modification), or other chemical modification. These treatments may be one type or two or more types. Examples of the rosin derivative include rosin ester, disproportionated rosin, disproportionated rosin ester, polymerized rosin, polymerized rosin ester, hydrogenated rosin, hydrogenated rosin ester, modified rosin, and modified rosin ester. These rosin derivatives may be used alone or two or more thereof may be mixed and used.

Commercially available products can be used as the rosin and/or the rosin derivative. Examples thereof include rosin esters such as HARIESTER P (pentaerythritol rosin ester, acid value: 6 to 12 mg KOH/g), HARIESTER-DS-70L (rosin ester, acid value: 8 mg KOH/g or less), HARITACK R-80 (rosin ester, acid value: 20 mg KOH/g or less), HARITACK FK100 (disproportionated rosin ester, acid value: 5 mg KOH/g or less), HARITACK FK125 (disproportionated rosin ester, acid value: 14 to 20 mg KOH/g), HARITACK SE10 (hydrogenated rosin ester, acid value: 2 to 10 mg KOH/g), HARITACK F85 (hydrogenated rosin ester, acid value: 4 to 12 mg KOH/g), HARITACK PH (hydrogenated rosin ester, acid value: 7 to 16 mg KOH/g), and HARITACK AQ-90A (rosin-modified special synthetic resin, acid value: 100 to 110 mg KOH/g); modified rosins and modified rosin esters such as HARITACK F-75 (specially modified rosin, acid value: 145 mg KOH/g or more), HARITACK FG-90 (specially modified rosin, acid value: 140 to 160 mg KOH/g), HARIMACK T-80 (maleinized rosin, acid value: 170 to 200 mg KOH/g), HARIMACK R-100 (maleinized rosin ester, acid value: 25 mg KOH/g or less), HARIMACK M-453 (maleinized rosin ester, acid value: 25 mg KOH/g or less), HARITACK 4740 (maleinized rosin ester, acid value: 25 to 35 mg KOH/g), HARIESTER MSR-4 (maleinized rosin ester, acid value: 120 to 150 mg KOH/g), and HARITACK 28JA (maleinized rosin ester, acid value: 39 mg KOH/g or less); and polymerized rosin esters such as HARITACK PCJ (polymerized rosin ester, acid value: 16 mg KOH/g or less), HARIESTER DS-130 (polymerized rosin ester, acid value: 20 mg KOH/g or less), and HARIESTER KT-3 (polymerized rosin ester, acid value: 17 mg KOH/g or less), which are manufactured by Harima Chemicals Group, Inc.

Examples thereof also include ultra-light rosins such as PINECRYSTAL KR-85 (ultra-light rosin, acid value: 165 to 175 mg KOH/g), PINECRYSTAL KR-612 (ultra-light rosin, acid value: 160 to 175 mg KOH/g), PINECRYSTAL KR-614 (ultra-light rosin, acid value: 170 to 180 mg KOH/g), PINECRYSTAL KE-100 (ultra-light rosin ester, acid value: 2 to 10 mg KOH/g), PINECRYSTAL KE-311 (ultra-light rosin ester, acid value: 2 to 10 mg KOH/g), PINECRYSTAL PE-590 (ultra-light rosin ester, acid value: 2 to 10 mg KOH/g), PINECRYSTAL KE-359 (ultra-light rosin ester, acid value: 10 to 20 mg KOH/g), PINECRYSTAL KE-604 (acid-modified ultra-light rosin, acid value: 230 to 245 mg KOH/g), PINECRYSTAL KR-120 (acid-modified ultra-light rosin, acid value: 305 to 345 mg KOH/g), PINECRYSTAL KR-140 (ultra-light color polymerized rosin, acid value: 130 to 160 mg KOH/g), PINECRYSTAL D-6011 (rosin-containing diol, acid value: 1 mg KOH/g or less), and PINECRYSTAL KR-50M (metal salt of ultra-light color rosin, acid value: 90 to 100 mg KOH/g); special rosin esters such as Super Ester A-18 (special rosin ester, acid value: 15 to 30 mg KOH/g), Super Ester A-75 (special rosin ester, acid value: 10 mg KOH/g or less), Super Ester A-100 (special rosin ester, acid value: 10 mg KOH/g or less), Super Ester A-115 (special rosin ester, acid value: 20 mg KOH/g or less), and Super Ester A-125 (special rosin ester, acid value: 20 mg KOH/g or less); rosin esters such as Ester Gum AA-L (rosin ester, acid value: 0.1 to 7.0 mg KOH/g), Ester Gum AA-G (rosin ester, acid value: 0.1 to 7.0 mg KOH/g), Ester Gum AA-V (rosin ester, acid value: 0.1 to 7.0 mg KOH/g), Ester Gum 105 (rosin ester, acid value: 20 mg KOH/g or less), Ester Gum AT (rosin ester, acid value: 10 mg KOH/g or less), Ester Gum H (hydrogenated rosin ester, acid value: 10 mg KOH/g or less), Ester Gum HP (hydrogenated rosin ester, acid value: 20 mg KOH/g or less), PENSEL GA-100 (rosin ester, acid value: 10 to 20 mg KOH/g), PENSEL AZ (rosin ester, acid value: 35 to 50 mg KOH/g), PENSEL C (polymerized rosin ester, acid value: 16 mg KOH/g or less), PENSEL D-125 (polymerized rosin ester, acid value: 20 mg KOH/g or less), PENSEL D-135 (polymerized rosin ester, acid value: 10 to 16 mg KOH/g), PENSEL D-160 (polymerized rosin ester, acid value: 10 to 16 mg KOH/g), and PENSEL KK (polymerized rosin ester, acid value: 10 to 25 mg KOH/g); polymerized rosins such as ARDYME Shiragiku rosin (purified rosin, acid value: 165 mg KOH/g or more), and ARDYME R-95 (polymerized rosin, acid value: 158 to 168 mg KOH/g); and maleic acid rosins such as MALKYD No. 1 (maleic acid rosin, acid value: 25 mg KOH/g or less), MALKYD No. 2 (maleic acid rosin, acid value: 20 to 39 mg KOH/g), MALKYD No. 5 (maleic acid rosin, acid value: 15 to 25 mg KOH/g), MALKYD No. 6 (maleic acid rosin, acid value: 39 mg KOH/g or less), MALKYD No. 8 (maleic acid rosin, acid value: 20 to 39 mg KOH/g), MALKYD No. 31 (maleic acid rosin, acid value: 175 to 200 mg KOH/g), MALKYD No. 32 (maleic acid rosin, acid value: 120 to 140 mg KOH/g), and MALKYD No. 33 (maleic acid rosin, acid value: 290 to 320 mg KOH/g), which are manufactured by Arakawa Chemical Industries, Ltd.

The content of the rosin and/or the rosin derivative is preferably 1 part by mass or more, more preferably 1.5 parts by mass or more, and further preferably 2 parts by mass or more, and preferably 15 parts by mass or less, more preferably 13 parts by mass or less, and further preferably 12 parts by mass or less with respect to 100 parts by mass of the rubber component. When the content of the rosin and/or the rosin derivative is less than 1 part by mass, the effect of improving the friction coefficient may not be obtained. Meanwhile, when the content of the rosin and/or the rosin derivative exceeds 15 parts by mass, not only can no further effects be obtained, but also there is a concern about deterioration of the processability such as sticking during kneading.

When the rubber composition of the present disclosure contains an organic peroxide described later as a vulcanizing agent, the acid value of the rosin and/or the rosin derivative is preferably 50 mg KOH/g or less, more preferably 30 mg KOH/g or less, and further preferably 20 mg KOH/g or less. This is because, when a rosin and/or a rosin derivative having a high acid value is incorporated in a rubber composition containing an organic peroxide, the wear resistance of the obtained roller tends to decrease. When the rubber composition does not contain an organic peroxide or the roller is not required to have wear resistance, the acid value of the rosin and/or the rosin derivative is not limited to the above range. In these cases, for example, rosins and/or rosin derivatives having an acid value of more than 50 mg KOH/g and 400 mg KOH/g or less can be used. It is also possible to adjust the incorporated amount of rosin and/or rosin derivative, the incorporated amount of organic peroxide, and the like to use.

[Other Components]

In the sheet transport roller rubber composition of the present disclosure, in addition to the rubber component and the rosin and/or the rosin derivative, if necessary, other components can be incorporated as long as the effects of the present disclosure are not impaired. Examples of the other components include additives generally used as rubber compounding agents such as vulcanizing agents, vulcanization accelerators, vulcanization aids, vulcanization retarders, fillers, pigments, processing aids, antioxidants, peptizers, heat-resistant stabilizers, weather-resistant stabilizers, and anti-static agents. These additives may be used alone, or two or more thereof may be used in combination.

(Vulcanizing Agent)

The sheet transport roller rubber composition of the present disclosure preferably contains a vulcanizing agent. The vulcanizing agent is a component for crosslinking rubber molecules to form a vulcanized product.

Examples of the vulcanizing agent include a vulcanizing agent which is generally used when crosslinking rubber, such as sulfur-based vulcanizing agent, organic peroxide, phenol resin, hydrosilicone-based compound, amino resin, quinone or a derivative thereof, amine-based compound, azo-based compound, epoxy-based compound, and isonanate-based compound. Of these, sulfur-based vulcanizing agent and organic peroxide are suitable.

Examples of the sulfur-based vulcanizing agent include powdered sulfur, precipitated sulfur, colloidal sulfur, and dispersible sulfur. These may be used alone or in combination of two or more. When a sulfur-based vulcanizing agent is used as the vulcanizing agent, it is preferable to use a vulcanization accelerator and/or a vulcanization acid described later in combination.

When a sulfur-based vulcanizing agent is used as the vulcanizing agent, the content of the sulfur-based vulcanizing agent is preferably 0.1 parts by mass or more, more preferably 0.2 parts by mass or more, and further preferably 0.5 parts by mass or more, and preferably 10 parts by mass or less, more preferably 8 parts by mass or less, and further preferably 5 parts by mass or less, with respect to 100 parts by mass of the rubber component.

Examples of the organic peroxide include dicumyl peroxide, di-tert-butyl peroxide, 2,5-di(tert-butylperoxy) hexane, 2,5-dimethyl-2,5-di(tert-butylperoxy)hexane, 2,5-dimethyl-2,5-di(tert-butylperoxy)hexin-3, 1,3-bis(tert-butylperoxyisopropyl)benzene, 1,1-bis(tert-butylperoxy)-3, 3,5-trimethylcyclohexane, n-butyl-4,4-bis(tert-butylperoxy) valerate, benzoyl peroxide, p-chlorobenzoyl peroxide, 2,4-dichlorobenzoyl peroxide, tert-butylperoxybenzoate, tert-butylperoxyisopropyl carbonate, diacetylperoxide, lauroyl peroxide, and tert-butyl cumyl peroxide. These organic peroxides may be used alone or in combination of two or more. It is preferable to use an organic peroxide as the vulcanizing agent because there is a little concern that the friction coefficient will decrease due to the bloom of the sulfur-based vulcanizing agent.

When an organic peroxide is used as the vulcanizing agent, the content of the organic peroxide is preferably 0.1 parts by mass or more, more preferably 0.5 parts by mass or more, and further preferably 1 part by mass or more, and preferably 15 parts by mass or less, more preferably 10 parts by mass or less, and further preferably 8 parts by mass or less, with respect to 100 parts by mass of the rubber component.

(Vulcanization Accelerator)

The sheet transport roller rubber composition of the present disclosure may contain a vulcanization accelerator. As the vulcanization accelerator, either an inorganic accelerator or an organic accelerator can be used. Examples of the inorganic accelerator include slaked lime, magnesia (MgO), litharge (PbO) and the like. Examples of the organic accelerator include a thiazole-based accelerator, a thiuram-based accelerator, a sulfenamide-based accelerator, a dithiocarbamate-based accelerator, and the like. The vulcanization accelerator may be used alone or in combination of two or more. As the vulcanization accelerator to be combined with the sulfur-based crosslinking agent, it is preferable to use a thiazole-based accelerator and a thiuram-based accelerator in combination.

Examples of the thiazole-based accelerator include 2-mercaptobenzothiazole, di-2-benzothiazolyl disulfide, 2-mercaptobenzothiazole zinc salt, 2-mercaptobenzothiazole cyclohexylamine salt, 2-(N,N-dimethylthiocarbamoylthio) benzothiazole, and 2-(4'-morpholinodithio)benzothiazole, and di-2-benzothiazolyl disulfide is preferable. Examples of the thiuram-based accelerator include tetramethylthiuram monosulfide, tetramethylthiuram disulfide, tetraethylthiuram disulfide, tetrabutylthiuram disulfide, tetrakis(2-ethylhexyl)thiuram disulfide, and dipentamethylene thiuram tetrasulfide, and tetramethylthiuram monosulfide is preferable.

The amount of the thiazole-based accelerator used is preferably 0.1 parts by mass or more and 10 parts by mass or less with respect to 100 parts by mass of the base rubber.

The amount of the thiuram-based accelerator used is preferably 0.1 parts by mass or more and 10 parts by mass or less with respect to 100 parts by mass of the base rubber.

(Vulcanization Acceleration Aid)

The sheet transport roller rubber composition of the present disclosure may contain a vulcanization acceleration aid. Examples of the vulcanization acceleration aid include zinc oxide. The amount of the vulcanization acceleration aid used is preferably 1 part by mass or more and 20 parts by mass or less with respect to 100 parts by mass of the base rubber.

(Other Components)

The sheet transport roller rubber composition of the present disclosure can use a compounding agent which is generally used as a compounding agent for rubber, such as a filler, a processing aid, an antioxidant, a peptizer, and a pigment, as long as the purpose of the present disclosure is not impaired.

As the filler, those generally used as a compounding agent for rubber can be used, and examples thereof include carbon black, silica, calcium carbonate, talc, clay, magnesium carbonate, aluminum oxide and the like. By incorporating the filler, the mechanical strength of the obtained roller can be improved.

The content of the filler is preferably 3 parts by mass or more, more preferably 5 parts by mass or more, and further preferably 10 parts by mass or more, and preferably 100 parts by mass or less, more preferably 70 parts by mass or less, further preferably 50 parts by mass or less, and particularly preferably 28 parts by mass or less with respect to 100 parts by mass of the base rubber.

When carbon black is incorporated as the pigment, the content of carbon black is preferably 3 parts by mass or less, and more preferably 1 part by mass or less with respect to 100 parts by mass of the base rubber. By reducing the incorporated amount of carbon black, it is possible to suppress the contamination of the transported sheet.

Examples of the processing aid include fatty acids (stearic acid and the like) having 12 to 30 carbon atoms, fatty acid esters, fatty acid metal salts, fatty acid amides, hydrocarbons (paraffin), process oils and the like.

Examples of the antioxidant include nickel diethyldithiocarbamate, nickel dibutyldithiocarbamate, and the like.

A method for producing a sheet transport roller rubber composition according to the present disclosure includes: a first step of obtaining a kneaded product obtained by kneading a rubber component containing an ethylene-α-olefin copolymer and a rosin and/or a rosin derivative at a temperature equal to or higher than a softening point of the rosin and/or the rosin derivative.

By kneading at a temperature equal to or higher than the softening point of the rosin and/or the rosin derivative, the rosin components are uniformly dispersed in the rubber component.

The final kneading temperature (temperature at the time of discharge) in the first step is preferably 3° C. or higher, more preferably 5° C. or higher, and further preferably 10° C. and higher, and preferably 50° C. or lower, more preferably 40° C. or lower, and further preferably 30° C. or lower than the softening point of the rosin and/or the rosin derivative.

In the first step, the kneading time of the rosin and/or the rosin derivative at the softening point or higher is preferably 1 minute or longer, more preferably 1.5 minutes or longer, and further preferably 2 minutes or longer, and preferably 15 minutes or shorter, more preferably 12 minutes or shorter, and further preferably 10 minutes or shorter.

In the first step, in addition to the rubber component containing the ethylene-α-olefin copolymer and the rosin and/or the rosin derivative, it is also preferable to incorporate a pigment, a filler and the like, if necessary.

In the method for producing the sheet transport roller rubber composition of the present disclosure, it is preferable not to incorporate a vulcanizing agent in the first step. This is because, when a vulcanizing agent is incorporated in the first step, the crosslinking reaction may proceed. In other words, it is preferable that the method for producing a sheet transport roller rubber composition of the present disclosure include a second step of cooling the kneaded product obtained in the first step and mixing the vulcanizing agent therewith. It is also preferable to incorporate a vulcanization accelerator and/or a vulcanization aid in addition to the vulcanizing agent in the second step.

The mixing temperature in the second step is not particularly limited, but is preferably 20° C. or higher, more preferably 30° C. or higher, further preferably 40° C. or higher, and preferably 120° C. or lower, more preferably 110° C. or lower, and further preferably 100° C. or lower.

The mixing time in the second step is not particularly limited as long as incorporation is sufficiently performed, but is preferably 1 minute or longer, more preferably 2 minutes or longer, and further preferably 3 minutes or longer, and preferably 30 minutes or shorter, more preferably 20 minutes or shorter, and further preferably 15 minutes or shorter.

The first step and the second step can be performed using, for example, a known kneader such as a kneading roll, a Banbury mixer, or a kneader.

The conditions for curing the sheet transport roller rubber composition of the present disclosure are not particularly limited, but for example, it is preferable to heat-mold at a temperature of 120° C. to 190° C. for 3 minutes to 60 minutes.

The hardness (durometer method, type A hardness) of the cured product of the rubber composition is preferably 10 or more, more preferably 15 or more, and further preferably 20 or more, and preferably 90 or less, more preferably 85 or less, and further preferably 80 or less. When the hardness of the cured product is 10 or more, the hardness becomes suitable for sheet transport and the transport force is further improved, and when the hardness is 90 or less, the press-fitting of the roller shaft is easier.

<Sheet Transport Roller>

The sheet transport roller of the present disclosure is obtained by curing the sheet transport roller rubber composition. Examples of the shape of the sheet transport roller include a cylindrical shape, a columnar shape, a polygonal cylindrical shape, and a polygonal columnar shape. When the sheet transport roller has a cylindrical shape or a polygonal cylindrical shape, it is preferable that the sheet transport roller have a shaft. The material of the shaft is not particularly limited, and examples thereof include metal, ceramic, and resin.

FIG. 1 shows an example of the sheet transport roller. The sheet transport roller 1 shown in FIG. 1 includes a roller main body 2 formed by molding the above-described rubber composition of the present disclosure into a cylindrical shape and crosslinking the rubber composition. A through-hole 3 having a circular cross section is provided at the center of the roller main body 2, and a columnar shaft 4 connected to a driving system (not shown) is inserted and fixed in the through-hole 3. The outer peripheral surface of the roller main body 2 is formed in a tubular shape concentric with the through-hole 3 and the shaft 4.

The roller main body 2 and the shaft 4 are fixed to each other so as not to cause idling, for example, by press-fitting the shaft 4 having an outer diameter larger than the inner diameter of the through-hole 3 into the through-hole 3 of the roller main body 2. In other words, due to the tightening allowance based on the diameter difference between the two, a constant idling torque (the limit torque at which idling does not occur) is secured therebetween.

The shaft 4 is made of, for example, metal, ceramic, hard resin, or the like. A plurality of roller main bodies 2 may be fixed to a plurality of locations on one shaft 4, if necessary.

Examples of the method for producing the roller main body 2 include a method in which a rubber composition is molded into a cylindrical shape by an extrusion molding method or the like and then crosslinked by a press crosslinking method or the like; and a method in which a rubber composition is molded into a cylindrical shape and crosslinked by a transfer molding method and the like.

The roller main body 2 may be polished such that the outer peripheral surface has a predetermined surface roughness, or may be knurled, grained, or the like, if necessary, at any time in the producing process. Further, both ends of the roller main body 2 may be cut such that the outer peripheral surface has a predetermined width. The outer peripheral surface of the roller main body 2 may be covered with any coat layer.

Further, the roller main body 2 may be formed in a two-layer structure of an outer layer on the outer peripheral surface side and an inner layer on the through-hole 3 side. In this case, it is preferable that at least the outer layer be formed by the rubber composition of the present disclosure. However, in consideration of simplifying the structure, improving productivity, and reducing the producing cost, it is preferable that the roller main body 2 have a single-layer structure as shown in FIG. 1.

Further, the roller main body 2 may have a porous structure. However, in order to improve wear resistance and reduce compression set such that dents due to deformation are less likely to occur even when the state of being in contact at one location continues for a relatively long period of time, the roller main body 2 is preferably a substantially non-porous structure.

The through-hole 3 may be provided at a position eccentric from the center of the roller main body 2 depending on the application of the sheet transport roller 1. Further, the outer peripheral surface of the roller main body 2 may have a deformed shape instead of a cylindrical shape, for example, a shape in which a part of the outer peripheral surface of the cylindrical shape is cut out into a plane shape or the like. In order to produce the sheet transport roller 1 provided having these deformed-shaped roller main bodies 2, the deformed-shaped roller main body 2 may be directly molded and then crosslinked by the above-described producing method, or the roller main body 2 molded into a cylindrical shape may have a deformed shape by post-processing.

Further, the roller main body 2 may be deformed into a deformed shape by press-fitting the shaft 4 having a deformed shape corresponding to the deformed shape of the roller main body 2, into the through-hole 3 of the roller main body 2 molded into a cylindrical shape.

In this case, polishing, knurling, grain processing or the like of the outer peripheral surface 5 can be performed on the cylindrical outer peripheral surface 5 before deformation, and thus processability can be improved.

<Image Forming Apparatus>

The sheet transport roller of the present disclosure can be integrated into various image forming apparatuses using an electrophotographic method, such as a laser printer, an electrostatic copier, a plain paper facsimile machine, or a combination machine thereof. Further, the sheet transport roller of the present disclosure can also be integrated into, for example, an ink jet printer, an ATM, or the like.

The sheet transport roller of the present disclosure rotates while in contact with a sheet such as a paper sheet, and transports the sheet by friction. The sheet transport roller can be used as, for example, a paper feed roller, a transport roller, a platen roller, a paper discharge roller, or the like.

The sheet transported by the sheet transport roller of the present disclosure may be a roll-shaped sheet or a sheet of paper cut to a predetermined size. The sheet transport roller of the present disclosure can be suitably used as a transport roller of a sheet of paper.

Examples

Hereinafter, the present disclosure will be described in detail by Examples, but the present disclosure is not limited to the following Examples, and any changes and embodiments that do not deviate from the purpose of the present disclosure are included within the range of the present disclosure.

[Evaluation Method]

(1) Hardness

The hardness of the cured product of the rubber composition was measured in accordance with JIS K6253-3 (2012). Specifically, the rubber composition was pressed at 170° C. for 20 minutes to manufacture a sheet having a thickness of 2 mm. In a state where three sheets were placed on top of each other so as not to be affected by the measurement substrate or the like, the pressure plate of the type A durometer was contacted, and the numerical value was read 3 seconds after the contact.

(2) Tensile Strength and Breaking Elongation

The tensile strength and breaking elongation (elongation at the time of cutting) of the cured product of the rubber composition were measured in accordance with JIS K6251 (2017). Specifically, the rubber composition was pressed at 170° C. for 20 minutes to manufacture a sheet having a thickness of 2 mm, and this manufactured sheet was punched into a dumbbell shape (dumbbell-shaped No. 3, parallel part thickness 2 mm, initial distance between marked lines 20 mm) to manufacture a test piece. Physical properties were measured using a tensile test measuring device (measurement temperature 23° C., tensile speed 500 mm/min). Then, the tensile strength was calculated by dividing the maximum tensile force recorded when the test piece was pulled until the test piece was cut by the cross-sectional area of the test piece before the test.

(3) Friction Coefficient Measurement

Figure 2:
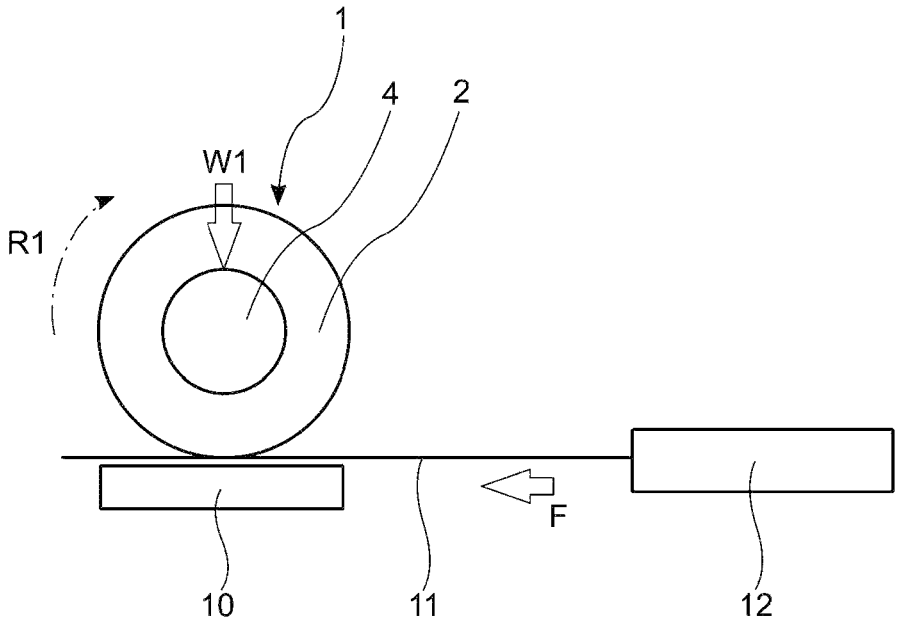
FIG. 2 is a view describing a method of measuring a friction coefficient and a wear reduction rate of the sheet transport roller of the present disclosure.

As shown in FIG. 2, a plain paper sheet 11 (P paper manufactured by Fuji Xerox Co., Ltd.) was placed on a horizontally installed plate 10 made of polytetrafluoroethylene (PTFE). The roller main body 2 of the sheet transport roller 1 was placed on the paper sheet 11, and a vertical load W1 (=300 gf) was applied to the shaft 4 and pressed against the plate 10.

Next, when the roller main body 2 is rotated at 200 rpm in the direction indicated by the arrow R1 of the one dot chain line in an environment of a temperature of 23° C. and a relative humidity of 55%, a transport force F (gf) applied to a load cell 12 connected to one end of the paper sheet 11 was measured. The initial friction coefficient μ was obtained from the measured transport force F and the vertical load W1 (=300 gf) by Equation (1).

$$\mu = F(\mathrm{gf})/W1(\mathrm{gf}) \quad (1)$$

(4) Forced Wear Test

As shown in FIG. 2, the plain paper sheet 11 (P paper manufactured by Fuji Xerox Co., Ltd.) was placed on a horizontally installed plate 10 made of polytetrafluoroethylene (PTFE). The roller main body 2 of the sheet transport roller 1 was placed on the paper sheet 11, and the vertical load W1 (=500 gf) was applied to the shaft 4 and pressed against the plate 10.

Next, in an environment of a temperature of 23° C. and a relative humidity of 55%, the roller main body 2 was continuously rotated at 200 rpm for 10 minutes in the direction indicated by the arrow R1 of the one dot chain line. The wear reduction rate (%) was obtained from a mass W0 (g) before the roller 1 was rotated and a mass W1 (g) after the rotation by the following Equation (2).

$$\text{Wear reduction rate (\%)} = 100 \times (W0 - W1)/W0 \quad \text{(Equation 2)}$$

(5) Method for Measuring Softening Point of Rosin and/or Rosin Derivative

The measurement was performed by the ring-and-ball method of JIS K 5902.

<Preparation of Rubber Composition>

Based on the formulation shown in Tables 1 to 4, the rubber component, the rosin component, the pigment, and the filler were input into the 3 L kneader, and kneaded at a temperature equal to or higher than the softening point of the rosin and/or the rosin derivative for 1 minute or longer to obtain a kneaded product. The obtained kneaded product was cooled, and a vulcanizing agent, a vulcanization accelerator, and a vulcanization aid were added to the kneaded product and mixed using an open roll of which the surface temperature is controlled to 30° C. to 50° C. to prepare a rubber composition.

<Manufacturing of Sheet Transport Roller>

The rubber composition prepared above was molded into a cylindrical shape by transfer molding under the molding condition of 170° C. and 30 minutes. A shaft having an outer diameter of 12 mm was press-fitted into the through-hole of the cylindrical molded article. In a state where the shaft is inserted, a cylindrical grinding machine was used to polish the cylindrical molded article such that the outer diameter was 22 mm, and the molded article was cut to a width of 25 mm to manufacture a cylindrical roller.

The evaluation results for each sheet transport roller are shown in Tables 1 to 4.

(Sheet Transport Rollers No. 1 to 6)

In sheet transport rollers No. 1 to 6, a vulcanization system in which sulfur, a vulcanization accelerator, and a vulcanization aid were incorporated was used as the rubber composition. From the results in Table 1, it can be seen that, in any of the rollers No. 1 to 5 in which the roller main body was formed of a rubber composition containing an appropriate amount of rosin components, the friction coefficient is improved compared to the roller No. 6 in which the roller main body was formed of a rubber composition that does not contain a rosin component.

TABLE 1

| | | | | Roller No. | | | | | |
|---|---|---|---|---|---|---|---|---|---|
| | | | | 1 | 2 | 3 | 4 | 5 | 6 |
| Formulation (parts by mass) | Rubber composition | Ethylene-α-olefin copolymer | EPDM1 | 100 | 100 | 100 | 100 | 100 | 100 |
| | | | EPDM2 | — | — | — | — | — | — |
| | | | EPDM3 | — | — | — | — | — | — |
| | | Other rubber compositions | SBR | — | — | — | — | — | — |
| | | | IR | — | — | — | — | — | — |
| | Rosin components | Pentaerythritol rosin ester | | 2 | — | — | — | — | — |
| | | Rosin-modified special synthetic resin | | — | 3 | — | — | — | — |
| | | Disproportionated rosin ester 1 | | — | — | 4 | — | — | — |
| | | Hydrogenated rosin ester | | — | — | — | 3 | — | — |
| | | Disproportionated rosin ester 2 | | — | — | — | 3 | 12 | — |
| | | Rosin ester | | — | — | — | — | — | — |
| | | Ultra-light rosin | | — | — | — | — | — | — |
| | | Maleic acid rosin | | — | — | — | — | — | — |
| | Vulcanizing agent | Sulfur | | 1 | 1 | 1 | 1 | 1 | 1 |
| | | Organic peroxide | | — | — | — | — | — | — |
| | Vulcanization accelerator | Thiuram-based vulcanization accelerator | | 3 | 3 | 3 | 3 | 3 | 3 |
| | | Thiazole-based vulcanization accelerator | | 2 | 2 | 2 | 2 | 2 | 2 |
| | Vulcanization aid | Zinc oxide | | 5 | 5 | 5 | 5 | 5 | 5 |
| | | Stearic acid | | 1 | 1 | 1 | 1 | 1 | 1 |
| | Pigment | Carbon black | | 0.5 | 0.5 | 0.5 | 0.5 | 0.5 | 0.5 |
| | Filler | Calcium carbonate | | 25 | 25 | 25 | 25 | 25 | 25 |
| Evaluation result | Hardness (type A) | | | 50 | 49 | 49 | 48 | 47 | 51 |
| | Tensile strength (MPa) | | | 2.5 | 3.2 | 2.1 | 1.9 | 2.2 | 2.1 |
| | Breaking elongation (%) | | | 405 | 475 | 370 | 350 | 420 | 350 |
| | Friction coefficient | | | 1.82 | 1.88 | 1.91 | 2.03 | 1.99 | 1.65 |
| | Wear reduction rate (%) | | | 0.08 | 0.11 | 0.05 | 0.06 | 0.09 | 0.05 |

(Sheet Transport Rollers No. 7 to 13)

In sheet transport rollers No. 7 to 13, a vulcanization system in which an organic peroxide was incorporated was used as the rubber composition. From the results in Table 2, it can be seen that, in any of the rollers No. 7 to 12 in which the roller main body was formed of a rubber composition containing an appropriate amount of rosin components, the friction coefficient is improved compared to the roller No. 13 in which the roller main body was formed of a rubber composition that does not contain a rosin component. In addition, it can be seen that, among these No. 7 to 12, in the rollers No. 7, 9, 10, and 12 having an acid value of a rosin component of 50 mg KOH/g or less, the wear resistance is more excellent compared to the rollers No. 8 and 11 in which the acid value of the rosin component is more than 50 mg KOH/g.

TABLE 2

| | | | | Roller No. | | | | | | |
|---|---|---|---|---|---|---|---|---|---|---|
| | | | | 7 | 8 | 9 | 10 | 11 | 12 | 13 |
| Formulation (parts by mass) | Rubber composition | Ethylene-α-olefin copolymer | EPDM1 | 100 | 100 | 100 | 100 | 100 | 100 | 100 |
| | | | EPDM2 | — | — | — | — | — | — | — |
| | | | EPDM3 | — | — | — | — | — | — | — |
| | | Other rubber compositions | SBR | — | — | — | — | — | — | — |
| | | | IR | — | — | — | — | — | — | — |
| | Rosin components | Pentaerythritol rosin ester | | 6 | — | — | — | — | — | — |
| | | Rosin-modified special synthetic resin | | — | 6 | — | — | — | — | — |
| | | Disproportionated rosin ester 1 | | — | — | 6 | — | — | — | — |
| | | Hydrogenated rosin ester | | — | — | — | 6 | — | — | — |
| | | Disproportionated rosin ester 2 | | — | — | — | — | — | — | — |
| | | Rosin ester | | — | — | — | — | — | — | — |
| | | Ultra-light rosin | | — | — | — | — | 6 | — | — |
| | | Maleic acid rosin | | — | — | — | — | — | 6 | — |
| | Vulcanizing agent | Sulfur | | — | — | — | — | — | — | — |
| | | Organic peroxide | | 3 | 3 | 3 | 3 | 3 | 3 | 3 |
| | Vulcanization accelerator | Thiuram-based vulcanization accelerator | | — | — | — | — | — | — | — |
| | | Thiazole-based vulcanization accelerator | | — | — | — | — | — | — | — |
| | Vulcanization aid | Zinc oxide | | — | — | — | — | — | — | — |
| | | Stearic acid | | — | — | — | — | — | — | — |
| | Pigment | Carbon black | | 0.5 | 0.5 | 0.5 | 0.5 | 0.5 | 0.5 | 0.5 |
| | Filler | Calcium carbonate | | 25 | 25 | 25 | 25 | 25 | 25 | 25 |

TABLE 2-continued

| | | Roller No. | | | | | | |
|---|---|---|---|---|---|---|---|---|
| | | 7 | 8 | 9 | 10 | 11 | 12 | 13 |
| Evaluation result | Hardness (type A) | 48 | 47 | 49 | 48 | 47 | 53 | 56 |
| | Tensile strength (MPa) | 2.2 | 2.5 | 1.9 | 1.8 | 2.1 | 2.9 | 2.2 |
| | Breaking elongation (%) | 440 | 480 | 345 | 385 | 453 | 412 | 220 |
| | Friction coefficient | 2.02 | 1.91 | 1.78 | 2.03 | 1.81 | 1.80 | 1.60 |
| | Wear reduction rate (%) | 0.35 | 0.74 | 0.31 | 0.29 | 0.70 | 0.26 | 0.21 |

(Sheet Transport Rollers No. 14 to 17)

In sheet transport rollers No. 14 to 17, a vulcanization system in which an organic peroxide was incorporated was used as the rubber composition. In these examples, as the rubber component, EPDM blended with SBR, which can be obtained at a relatively low cost, was used. From the results in Table 3, it can be seen that, in any of the rollers No. 14 to 16 in which the roller main body was formed of a rubber composition containing an appropriate amount of rosin components, the friction coefficient is improved compared to the roller No. 17 in which the roller main body was formed of a rubber composition that does not contain a rosin component.

(Sheet Transport Rollers No. 18 to 21)

In sheet transport rollers No. 18 to 21, a vulcanization system in which an organic peroxide was incorporated was used as the rubber composition. In these examples, as the rubber component, two types of EPDM blended with IR for the purpose of improving the friction coefficient were used. From the results in Table 4, it can be seen that, in any of the rollers No. 18 to 20 in which the roller main body was formed of a rubber composition containing an appropriate amount of rosin components, the friction coefficient is improved compared to the roller No. 21 in which the roller main body was formed of a rubber composition that does not contain a rosin component.

TABLE 3

| | | | | Roller No. | | | |
|---|---|---|---|---|---|---|---|
| | | | | 14 | 15 | 16 | 17 |
| Formulation (parts by mass) | Rubber composition | Ethylene-α-olefin copolymer | EPDM1 | 70 | 70 | 70 | 70 |
| | | | EPDM2 | — | — | — | — |
| | | | EPDM3 | — | — | — | — |
| | | Other rubber compositions | SBR | 30 | 30 | 30 | 30 |
| | | | IR | — | — | — | — |
| | Rosin components | Pentaerythritol rosin ester | | — | — | — | — |
| | | Rosin-modified special synthetic resin | | — | — | — | — |
| | | Disproportionated rosin ester 1 | | — | — | — | — |
| | | Hydrogenated rosin ester | | — | — | — | — |
| | | Disproportionated rosin ester 2 | | 4 | — | — | — |
| | | Rosin ester | | — | 4 | — | — |
| | | Ultra-light rosin | | — | — | 4 | — |
| | | Maleic acid rosin | | — | — | — | — |
| | Vulcanizing agent | Sulfur | | — | — | — | — |
| | | Organic peroxide | | 2.5 | 2.5 | 2.5 | 2.5 |
| | Vulcanization accelerator | Thiuram-based vulcanization accelerator | | — | — | — | — |
| | | Thiazole-based vulcanization accelerator | | — | — | — | — |
| | Vulcanization aid | Zinc oxide | | — | — | — | — |
| | | Stearic acid | | — | — | — | — |
| | Pigment | Carbon black | | 0.5 | 0.5 | 0.5 | 0.5 |
| | Filler | Calcium carbonate | | 25 | 25 | 25 | 25 |
| Evaluation result | Hardness (type A) | | | 54 | 55 | 52 | 61 |
| | Tensile strength (MPa) | | | 5.2 | 5.7 | 5.1 | 7.0 |
| | Breaking elongation (%) | | | 220 | 290 | 380 | 200 |
| | Friction coefficient | | | 1.79 | 1.72 | 1.88 | 1.44 |
| | Wear reduction rate (%) | | | 0.39 | 0.39 | 0.88 | 0.16 |

TABLE 4

| | | | | Roller No. | | | |
|---|---|---|---|---|---|---|---|
| | | | | 18 | 19 | 20 | 21 |
| Formulation (parts by mass) | Rubber composition | Ethylene-α-olefin copolymer | EPDM1 | — | — | — | — |
| | | | EPDM2* | 110 (55) | 110 (55) | 110 (55) | 110 (55) |
| | | | EPDM3 | 20 | 20 | 20 | 20 |
| | | Other rubber compositions | SBR | — | — | — | — |
| | | | IR | 25 | 25 | 25 | 25 |
| | Rosin components | Pentaerythritol rosin ester | | 7 | — | — | — |
| | | Rosin-modified special synthetic resin | | — | — | — | — |
| | | Disproportionated rosin ester 1 | | — | — | — | — |
| | | Hydrogenated rosin ester | | — | 5 | — | — |
| | | Disproportionated rosin ester 2 | | — | — | — | — |
| | | Rosin ester | | — | — | — | — |
| | | Ultra-light rosin | | — | — | 3 | — |
| | | Maleic acid rosin | | — | — | — | — |
| | Vulcanizing agent | Sulfur | | — | — | — | — |
| | | Organic peroxide | | 3 | 3 | 3 | 3 |
| | Vulcanization accelerator | Thiuram-based vulcanization accelerator | | — | — | — | — |
| | | Thiazole-based vulcanization accelerator | | — | — | — | — |
| | Vulcanization aid | Zinc oxide | | — | — | — | — |
| | | Stearic acid | | — | — | — | — |
| | Pigment | Carbon black | | 10 | 10 | 10 | 10 |
| | Filler | Calcium carbonate | | — | — | — | — |
| Evaluation result | Hardness (type A) | | | 38 | 39 | 41 | 42 |
| | Tensile strength (MPa) | | | 3.0 | 2.2 | 3.6 | 3.1 |
| | Breaking elongation (%) | | | 620 | 520 | 570 | 460 |
| | Friction coefficient | | | 2.55 | 2.51 | 2.48 | 2.21 |
| | Wear reduction rate (%) | | | 0.22 | 0.15 | 0.53 | 0.10 |

*The parentheses indicate the part by mass of the rubber itself as a solid content excluding the extender oil.

The materials used in Tables 1 to 4 are as follows.

EPDM1: Esprene 505A [ethylene content: 50%, diene content: 9.5%, non-oil-extended type] manufactured by Sumitomo Chemical Co., Ltd.

EPDM2: Esprene 670F [ethylene content: 66%, diene content: 4.0%, oil extension amount: 100 phr] manufactured by Sumitomo Chemical Co., Ltd.

EPDM3: Esprene 586 [ethylene content: 66%, diene content: 12.5%, non-oil-extended type] manufactured by Sumitomo Chemical Co., Ltd.

SBR: Nipol 1502 manufactured by Zeon Corporation

IR: Nipol IR2200 manufactured by Zeon Corporation

Pentaerythritol rosin ester: HARIESTER P [softening point: 98 to 106° C., acid value: 6 to 12 mg KOH/g] manufactured by Harima Chemicals Group, Inc.

Rosin-modified special synthetic resin: HARITACK AQ-90A [softening point: 100 to 110° C., acid value: 100 to 110 mg KOH/g] manufactured by Harima Chemicals Group, Inc.

Disproportionated rosin ester 1: PINECRYSTAL KE-100 [softening point: 95 to 105° C., acid value: 2 to 10 mg KOH/g] manufactured by Arakawa Chemical Industries, Ltd.

Hydrogenated rosin ester: Ester Gum H [softening point: 68° C. or higher, acid value: mg KOH/g or less] manufactured by Arakawa Chemical Industries, Ltd.

Disproportionated rosin ester 2: Super Ester KE-100 [softening point: 95 to 105° C., acid value: 10 mg KOH/g or less] manufactured by Arakawa Chemical Industries, Ltd.

Rosin ester: Ester Gum 105 [softening point: 100 to 110° C., acid value: 20 mg KOH/g or less] manufactured by Arakawa Chemical Industries, Ltd.

Ultra-light rosin: PINECRYSTAL KR-612 [softening point: 80 to 90° C., acid value: 160 to 175 mg KOH/g] manufactured by Arakawa Chemical Industries, Ltd.

Maleic acid rosin: MALKYD No. 8 [softening point: 130 to 140° C., acid value: 20 to 39 mg KOH/g] manufactured by Arakawa Chemical Industries, Ltd.

Sulfur: 5% oil-containing fine sulfur powder manufactured by Tsurumi Chemical Industry Co., Ltd.

Organic peroxide: PERCUMYL (registered trademark) D manufactured by NOF CORPORATION Thiram-based vulcanization accelerator: Noxeller TOT-N manufactured by Ouchi-Shinko Chemical Industrial Co., Ltd.

Thiazole-based vulcanization accelerator: Noxeller DM manufactured by Ouchi-Shinko Chemical Industrial Co., Ltd.

Zinc oxide: Two types of zinc oxide manufactured by Mitsui Mining & Smelting Co., Ltd.

Stearic acid: CAMELLIA manufactured by NOF CORPORATION

Carbon Black: Seest 3 manufactured by Tokai Carbon Co., Ltd.

Calcium carbonate: BF-300 manufactured by Bihoku Funka Kogyo Co., Ltd.

INDUSTRIAL APPLICABILITY

According to the sheet transport roller rubber composition of the present disclosure, a sheet transport roller having a high friction coefficient can be obtained.

There is provided a sheet transport roller rubber composition according to the present disclosure (1) containing a rubber component containing an ethylene-α-olefin copolymer and a rosin and/or a rosin derivative.

A sheet transport roller rubber composition according to the present disclosure (2) is the sheet transport roller rubber composition described in the present disclosure (1), in which a content of the ethylene-α-olefin copolymer in the rubber component is 50% by mass or more.

A sheet transport roller rubber composition according to the present disclosure (3) is the sheet transport roller rubber composition described in the present disclosure (1) or (2), containing 1 part by mass to 15 parts by mass of the rosin and/or the rosin derivative with respect to 100 parts by mass of the rubber component.

A sheet transport roller rubber composition according to the present disclosure (4) is the sheet transport roller rubber composition described in any one of the present disclosures (1) to (3), in which an organic peroxide is contained as a vulcanizing agent and an acid value of the rosin and/or the rosin derivative is 50 mg KOH/g or less.

A sheet transport roller rubber composition according to the present disclosure (5) is the sheet transport roller rubber composition described in any one of the present disclosures (1) to (4), further containing a diene-based rubber as the rubber component.

A sheet transport roller rubber composition according to the present disclosure (6) is the sheet transport roller rubber composition described in the present disclosure (5), in which the diene-based rubber is an isoprene rubber and/or a natural rubber.

A sheet transport roller rubber composition according to the present disclosure (7) is a sheet transport roller rubber composition described in any one of the present disclosures (1) to (6), in which the sheet is a sheet of paper.

There is provided a sheet transport roller according to the present disclosure (8), which is obtained by curing the sheet transport roller rubber composition described in any one of the present disclosures (1) to (7).

There is provided a method for producing a sheet transport roller rubber composition according to the present disclosure (9), including: a first step of obtaining a kneaded product obtained by kneading a rubber component containing an ethylene-α-olefin copolymer and a rosin and/or a rosin derivative at a temperature equal to or higher than a softening point of the rosin and/or the rosin derivative.

A method for producing a sheet transport roller rubber composition according to the present disclosure (10) is the method for producing a sheet transport roller rubber composition described in the present disclosure (9), further including: a second step of mixing a vulcanizing agent with the kneaded product.

What is claimed is:

1. A sheet transport roller rubber composition containing
a rubber component containing an ethylene-α-olefin copolymer and a rosin and/or a rosin derivative, wherein
an acid value of the rosin and/or the rosin derivative is 50 mg KOH/g or less.

2. The sheet transport roller rubber composition according to claim 1, wherein
a content of the ethylene-α-olefin copolymer in the rubber component is 50% by mass or more.

3. The sheet transport roller rubber composition according to claim 1, containing
1 part by mass to 15 parts by mass of the rosin and/or the rosin derivative with respect to 100 parts by mass of the rubber component.

4. The sheet transport roller rubber composition according to claim 1, wherein
an organic peroxide is contained as a vulcanizing agent.

5. The sheet transport roller rubber composition according to claim 1, further containing
a diene-based rubber as the rubber component.

6. The sheet transport roller rubber composition according to claim 5, wherein
the diene-based rubber is an isoprene rubber and/or a natural rubber.

7. The sheet transport roller rubber composition according to claim 1, wherein
the sheet is a sheet of paper.

8. A sheet transport roller obtained by curing the sheet transport roller rubber composition according to claim 1.

9. A method for producing a sheet transport roller rubber composition, comprising:
a first step of obtaining a kneaded product obtained by kneading a rubber component containing an ethylene-α-olefin copolymer and a rosin and/or a rosin derivative at a temperature equal to or higher than a softening point of the rosin and/or the rosin derivative, wherein
an acid value of the rosin and/or the rosin derivative is 50 mg KOH/g or less.

10. The method for producing a sheet transport roller rubber composition according to claim 9, further comprising:
a second step of mixing a vulcanizing agent with the kneaded product.

* * * * *